United States Patent [19]

Kappler

[11] 4,375,863

[45] Mar. 8, 1983

[54] MECHANISM FOR AUTOMATICALLY CLOSING A STORAGE CONTAINER

[76] Inventor: Felix Kappler, Reismühleweg 62, Winterthur, Switzerland

[21] Appl. No.: 323,356

[22] Filed: Nov. 20, 1981

[30] Foreign Application Priority Data

Dec. 3, 1980 [CH] Switzerland ..... 8920/80
Feb. 20, 1981 [CH] Switzerland ..... 1123/81

[51] Int. Cl.[3] ..... B65D 43/14; B65D 51/04

[52] U.S. Cl. ..... 220/334; 220/22; 220/263; 220/264; 220/335

[58] Field of Search ..... 220/334, 335, 22, 262, 220/263, 264

[56] References Cited

U.S. PATENT DOCUMENTS 2,850,200 9/1958 Hofmann ..... 220/334
3,093,258 6/1963 Turner ..... 220/335

*Primary Examiner*—George T. Hall
*Attorney, Agent, or Firm*—Toren, McGeady & Stanger

[57] ABSTRACT

A mechanism for closing the cover of a storage container, such as a container for an assortment of items or parts, includes a stop pin slidably mounted in a guide sleeve for movement into a first position where it engages a support lever attached to the cover and holds the cover in the open position, and a second position where the cover is automatically closed. A spring is arranged to bias the stop pin out of engagement with the support lever when the storage container is removed or displaced from a support surface with the cover being moved by another biasing arrangement into the closed position.

8 Claims, 9 Drawing Figures

FIG.2
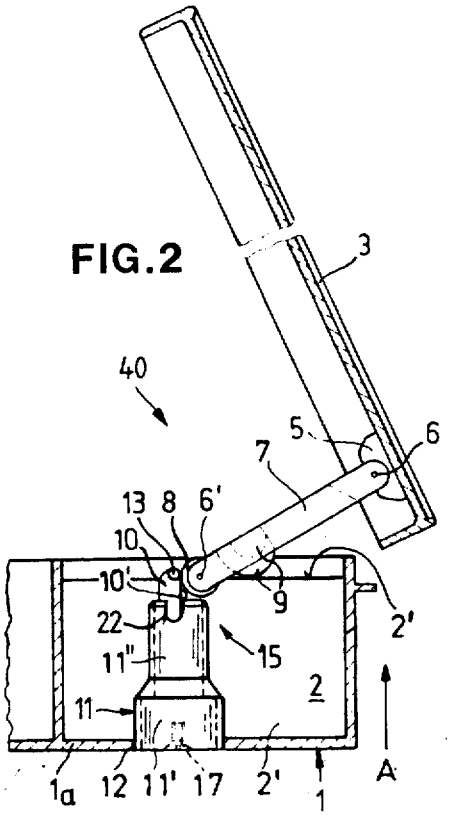
FIG.3
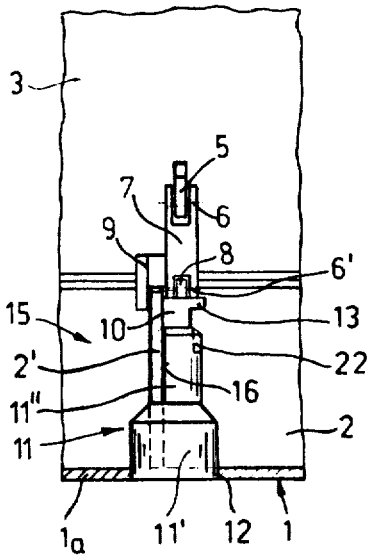
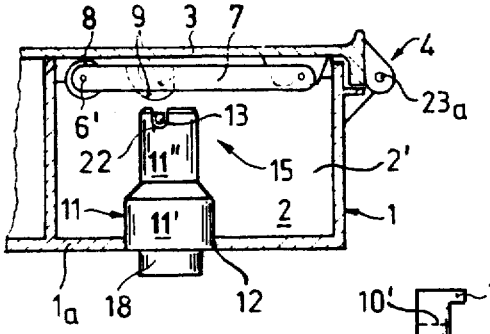
FIG.4
FIG.5
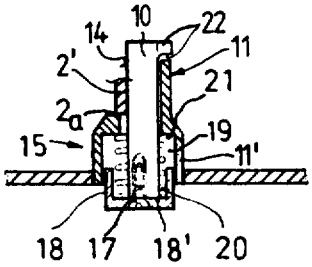
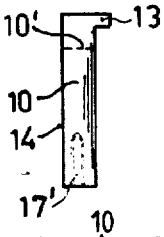
FIG.6
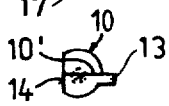
FIG.7

MECHANISM FOR AUTOMATICALLY CLOSING A STORAGE CONTAINER

SUMMARY OF THE INVENTION

The present invention is directed to a mechanism for automatically closing a storage container particularly a small rectangular container holding an assortment of items or parts. The storage container includes a box-like part with a cover hinged to it so that the cover can be moved into an open position against the restoring or biasing force of a first spring. The cover is held in the open position by a stop mechanism and if the container is lifted or displaced from a support surface, the cover is automatically returned into the closed position on the box-like part.

In Swiss Pat. No. A 230 392 there is a known container for storing items such as rivets, screws, studs or the like and it includes two pivotally mounted covers for closing the container. In cross section, the container has the form of a circular sector and it is divided into individual compartments by means of side walls and partitions. Each cover is supported by an individual feeler lever located under the container. The feeler lever is constructed as an angle lever and has a peg at one end which can be brought into engagement with the cover and it has a contact element at the other end which rests on a base. Both covers can be pivoted to the open position against the biasing force of one spring and the covers can be moved parallel to the circular section-shaped walls. In the open position, the peg of the feeler lever locks into a recess on the cover and holds the cover in place. When the container no longer rests on the base, the feeler levers release the covers which then move automatically due to the biasing action of the springs into the closed position. During the closing step it is unavoidable that the weight of one feeler part of each feeler lever is sufficient to overcome the force which acts, due to the restoring force of the spring, with the cover recess against the peg, for accomplishing a rapid, effective release and closure of the cover and thereby prevent any loss of the container contents.

In another Swiss Pat. No. A 530 912 a container is disclosed made up of a rectangular box and a cover hinged to the box. In the closed position, the cover has a circumferentially extending flange resting on a flange formed on the box. A pair of hinge elements are positioned in spaced relation on the rear of the container. Each element has a fork-shaped lug which engages around a hinge shaft on the box. The lugs are held by a flat spring. To lock the cover, individual locking elements, such as spring catches, are provided on the side opposite the hinges.

Therefore, it is the primary object of the present invention to provide a mechanism for closing the cover of a storage container, such as a container for holding an assortment of items or parts, where the cover is hinged to the lower box-like part of the container and includes means biasing the cover into the closed position. A stop member is arranged to counter the closing action of the spring means and to retain the cover in the open position. By displacing the stop means the cover can be automatically returned to the closed position when the storage container is lifted or displaced from a support base. The structure embodying the invention provides a simple arrangement for fixing the hinged cover in the open position. Moreover, an effective release of the fixing members is afforded so that the cover can be moved automatically into the closed position. In moving the cover to the closed position on the box, the mechanism is constructed so that hardly any force must be overcome in releasing the holding action on the cover when a small lifting motion or displacing motion is imparted to the container. As a result, the parts making up the container can be manufactured of plastics materials or the like.

In accordance with the present invention, the mechanism for closing the storage container includes a guide sleeve positioned on the bottom of the lower box-like part with a stop pin axially slidable in the guide sleeve and with a spring acting on the pin and biasing it out of holding engagement with the cover. In the open position of the storage container, the stop pin engages and secures a supporting lever hinged to the cover. If a small lifting or tilting motion acts on the container, the biasing action of the spring moves the stop pin so that it releases the cover permitting the cover to move into the closed position.

Another feature of the invention is the provision of a locking element which affords a snap-like closing action preventing the hinged cover from rebounding from the closed to the open position.

To provide a delayed and then accelerated end phase as the cover is closed, a bipolar magnetic element is provided on the box-like part and another similar magnetic element is located on the hinged cover.

Tests have shown that in a small storage container holding an assortment of parts and equipped with the mechanism embodying the present invention, the hinged cover held in the open position can be returned to the closed position effecting a snap-like closing action if a small lifting or tilting motion of the container occurs or if the container is intentionally pushed off a support base, such as a table or workbench. With the automatic closing of the cover, the parts or elements in the container, such as a variety of electronic elements, screws or the like, are prevented from falling out of the container or from becoming mixed with one another. The magnetic element locking parts located on the box-like part and on its hinged cover have proven to be particularly advantageous and assure that the hinged cover does not fly open if the container impacts on a hard surface.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 2 is a sectional view taken along the line II—II in FIG. 1 and illustrated on an enlarged scale, with the stop mechanism positioned in the box-like part and on the hinged cover;

FIG. 3 is a side view of the stop mechanism shown in FIG. 2 located in the box-like part and on the hinged cover;

FIG. 4 is a sectional view similar to that shown in FIG. 2, however, with the container illustrated in the closed position;

FIG. 5 is a cross-sectional view of a part of the stop mechanism;

FIG. 6 is an elevational view of one of the parts of the stop mechanism illustrated in FIG. 5;

FIG. 7 is a plan view of the part shown in FIG. 6;

DETAIL DESCRIPTION OF THE INVENTION

Figure 1:
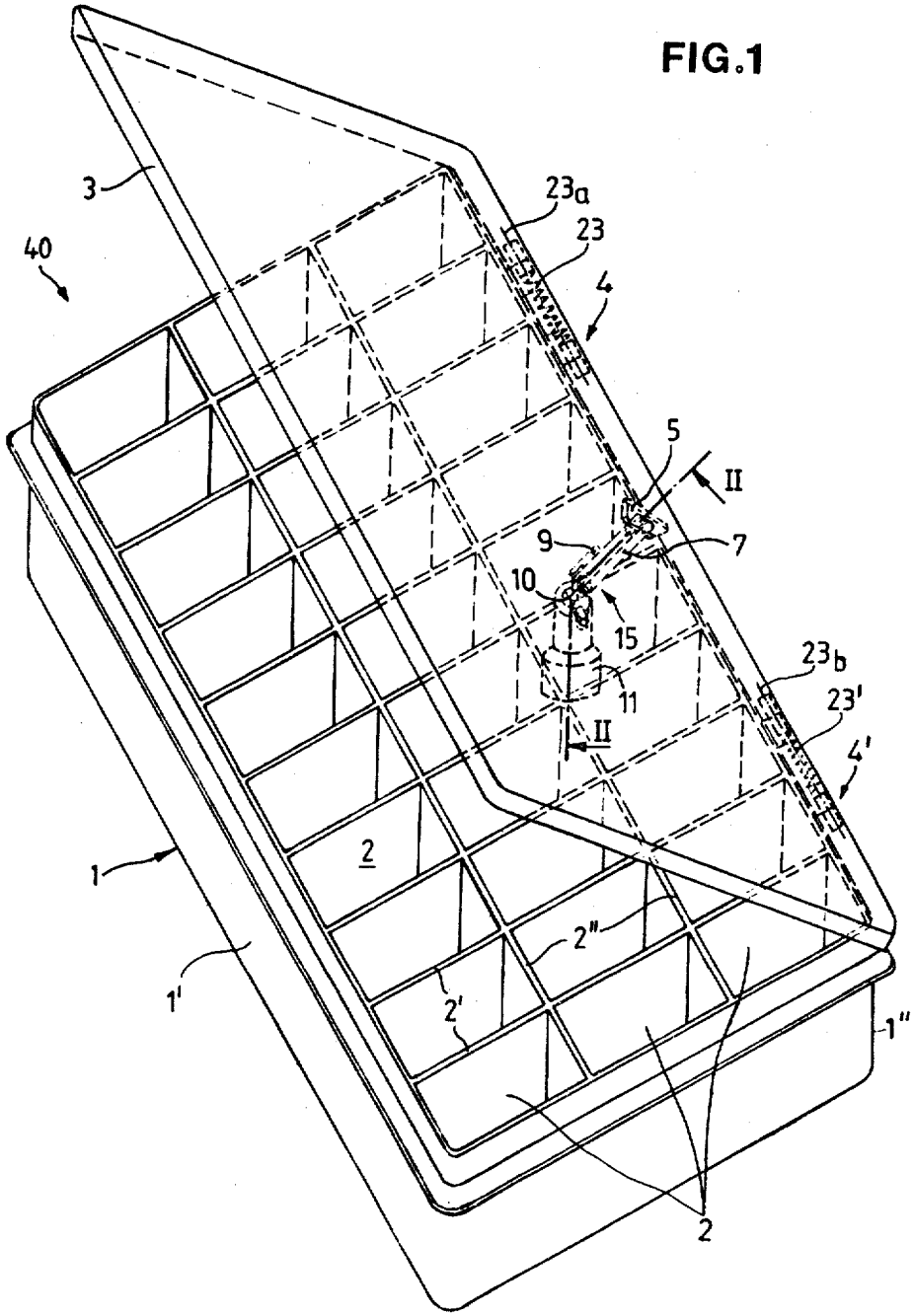
FIG. 1 is a perspective view of a storage container including a box-like part with a cover hinged to it and held in the open position by a stop mechanism.

In FIG. 1 a storage container 40 is shown in a perspective view. The container 40 consists of a box-like part 1 and a hinged cover 3 connected to it and shown in the open position. Hinged cover 3 is secured by a pair of hinges 4, 4' shown schematically and spaced apart along the rear side wall of the container. As illustrated, the container 40 is rectangular in shape and its interior is divided by a number of wall portions 2', 2'' extending transversely of one another into a plurality of compartments 2. Such a container having a partitioned interior is known and is generally characterized as a small storage container for holding an assortment of parts. Each of the hinges 4, 4' located on the rear wall 1'' of the box-like part 1 has two bearing parts located on the hinged cover and another two located on the rear wall 1''. A helical spring 23, 23' extends between the bearing parts and is held by a schematically shown bolt or pin $23_a$, $23_b$ which extend through the bearing parts. Each helical spring has two spring arms, not further described, one of which rests on the box-like part 1 with the other bearing against the hinged cover 3 and the spring is stressed during the opening of the hinged cover. Further, FIG. 1 displays a stop mechanism 15 which holds the hinged cover 3 in the open position and the stop mechanism is more fully described below.

In FIG. 2 stop mechanism 15 is arranged within the container 40. The stop mechanism comprises a guide sleeve 11 secured to the bottom $1_a$ of the box-like part 1 and extending in the upward direction of the container. A stop pin 10 is axially slidably guided in the guide sleeve. The stop mechanism includes an elongated supporting lever 7 engaged, in the open position, at its front end with the stop pin 10 and its rear end is hinged to the cover 3. At its rear end, the supporting lever 7 is pivotally secured to a holding member 5 attached to the inside of the cover 3. The supporting lever 7 is held at the holding member 5 by a pin or bolt 6 which extends through the supporting lever and the holding member. A roller 8 is rotatably mounted on the front end of the supporting lever 7 and, in the illustrated closed position of FIG. 2, it is in contact with the stop pin 10. A pin or bolt 6' secures the roller 8 to the supporting lever. Spaced between the ends of the supporting lever 7 at a distance from the roller 8, is an angle section 9 forming a guide member so that the supporting lever is slidingly guided over the top of the wall portion 2' while the cover is moved between the open and closed positions.

In FIG. 3 there is a side view of the stop mechanism 15 when the cover is in the open position and with the stop mechanism in engagement with the box-like part 1 and the cover 3. Supporting lever 7 has a fork-shaped rear end pivoted to the holding member 5 secured on the cover 3. At its opposite or front end the supporting lever 7 is also fork-shaped and supports the roller 8 and is guided along the top of the wall portion 2' by the laterally extending angle shaped-section 9. In FIG. 3 guide sleeve 11 is shown having a base portion 11' secured within a recess 12 in the bottom $1_a$ of the box-like part 1. Stop pin 10 extends upwardly from the guide sleeve 11 and has a transversely extending projection 13 which serves as a stop. Guide sleeve 11 includes an upper portion 11'' containing a groove 22 extending in the axial direction of the pin and the sleeve, and the groove is arranged to receive the projection 13.

In FIG. 4 the stop mechanism 15 is shown in the position it adopts when the container is closed and the stop mechanism is unstressed. In this figure the box-like part 1 is shown along with the hinged cover 3, the hinge 4 including hinge pin $23_a$ and the supporting lever 7 hinged to the inside of the cover with its angle-shaped section 9 resting on the top edge of the adjacent wall portion 2'. Preferably, this particular wall portion 2' is somewhat lower than the remaining wall portions. Further, the roller 8 is shown on the front end of the supporting lever. In FIG. 4 it can be noted that the guide sleeve 11 is attached to the bottom $1_a$ of the box-like part 1 and the lateral projection 13 on the stop pin 10 is located in the groove 22. An actuating member 18 is slidably mounted in the bottom of the guide sleeve 11 and extends downwardly below the bottom $1_a$ of the box-like part 1.

FIG. 5 displays a section through the plane of symmetry of guide sleeve 11 with the stop pin 10 positioned within the sleeve so that it is slidable in the common axial direction of the pin and sleeve. Cap-shaped actuating member 18 is secured by a screw 17 to the bottom of the stop pin 10. The bottom portion 11' of the guide sleeve 11 forms a recess 19 around the pin 10. Within the recess 19, a compression spring 20 encircles the stop pin and is supported at its upper end against the surface 21 of the recess 19 and at its lower end against the inside surface 18' of the actuating member 18. As mentioned above, the container is shown in the unstressed state in FIGS. 4 and 5, in the stressed state when the container rests on a support base, the actuating member is pressed inwardly into the recess 19 against the biasing force of spring 20 with the lower outside surface of the actuating member disposed in the same plane with the outside surface of the bottom $1_a$ of the container, note the stop mechanism 15 shown in FIGS. 2 and 3.

In FIGS. 6 and 7, the stop pin 10 which, for the most part, has a rounded outside surface, is shown in elevation and plan. Though for the most part its outside surface is rounded, the stop pin 10 has a flat elongated side 14 and its upper end has a recess 10' extending downwardly from the top for about half of the cross section of the pin. In other words, the recess extends laterally from a vertical plane coinciding with one side of the projection 8 to the outside surface of the pin. The vertical wall of the recess 10' serves in the open position of the hinge cover 3 as a contact surface for the roller 8 rotatably mounted on the front end of the supporting lever 7, note FIG. 2. At its lower end, stop pin 10 has a tapped hole 17' into which the screw 17 can be threaded.

As illustrated in FIGS. 3 and 5, guide sleeve 11 is formed integrally with the adjacent wall portion 2' and its upper portion 11'' has a flattened surface 16 formed by the wall portion 2' with the lower portion 11' having a corresponding recess $2_a$ penetrating the all portion 2', which is shown only partially in FIG. 5. Stop pin 10 is guided in the sleeve 11 with its axially extending flat side 14 in contact with the wall portion 2' so that it is secured against rotation.

Figure 8:
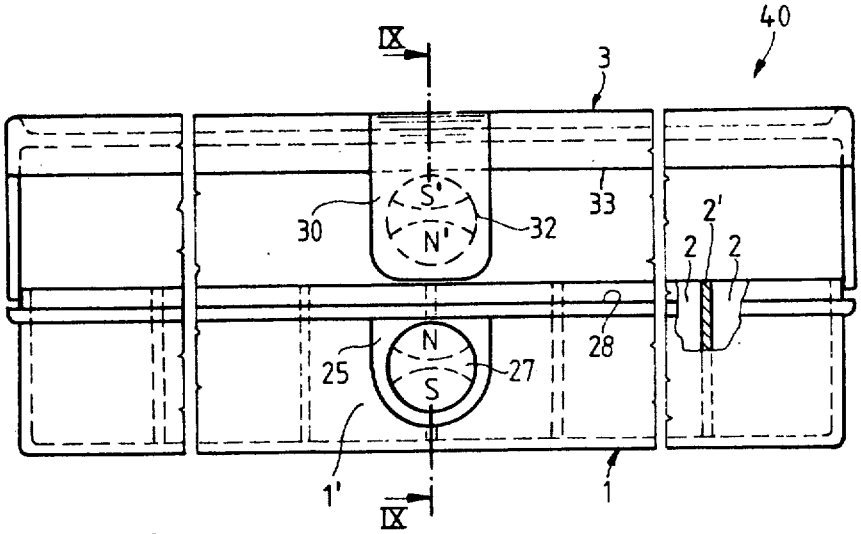
FIG. 8 is a front elevational view of the container showing the locking parts located on the side of the box-like part and of the hinged cover.

In FIG. 8 the storage container 40 is viewed looking at the front side of the box-like part 1 and of the hinged cover 3. A first locking part 25 is provided on the front face of the box-like part 1, that is, it is formed on the outside surface 1' of the front side. Locking part 25 has a recess 26 in which a first magnetic element 27 is secured by means, not shown. A stepped surface 28 is arranged around the outside of the box-like part 1, located above the first locking part 25, and serving, in the closed position of the container, as a support for the cover 3. Corresponding to the locking part 25 arranged on the box-like part 1, another locking part 30 is arranged on the front face of the cover 3. Preferably, locking part 30 is formed on the hinge cover and has a recess 31 in which a second magnetic element 32 is secured by means, not shown. A downwardly facing edge surface 33 extends around the interior of the cover 3 and in the closed position of the container 40, the edge surface 33 rests on the stepped surface 28 on the box-like part. To illustrate clearly that the compartments 2 are separated by the wall portion 2', in FIG. 8 a part of the front side of the box-like part 1 is shown broken away.

Figure 9:
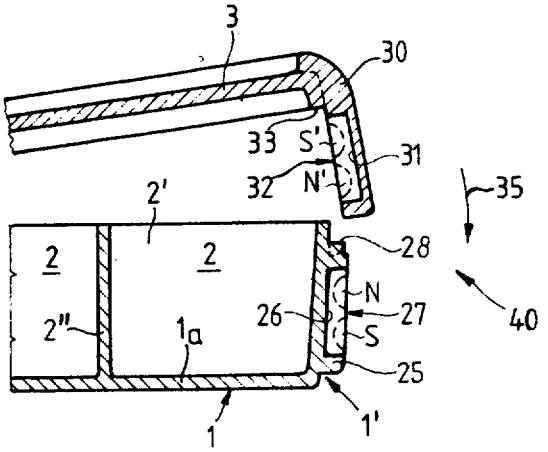
FIG. 9 is a partial sectional view of the container taken along line IX—IX in FIG. 8 with the hinged cover in a partly open position moving toward the box-like part.

In FIG. 9 a portion of the storage container 40 is shown in section along the line IX—IX in FIG. 8 and the cover 3 is shown moving in the direction of the arrow 35 toward the closed position. The first magnetic element 27 positioned within the recess 26 in the locking part 25 located on the outer surface 1' of the box-like part, includes polarity segments N and S. Similarly, in the corresponding side of the cover 3, locking part 30 includes the second magnetic element 32 within the recess 31 and the magnetic element includes the polarity segments N' and S'.

The polarity segments N, S and N', S' of the magnetic segments 27, 32 are arranged relative to one another as viewed in the closing direction 35 so that initially the two unipolar segments N, N' are disposed opposite one another and then in the closed position and the polarity segments N,S' and S, N' are aligned opposite one another with the opposite segments having opposed polarity. Locking parts 25, 30 are preferably formed as integral parts of the box-like part 1 and the cover 3, respectively. In the closed position of the container 40 the magnetic elements overlap. In FIG. 9, two compartments 2 are shown defined by the bottom $1_a$ and separated in the vertical direction by wall portions 2', 2" extending transversely of one another.

The magnetic elements 27, 32 positioned in the locking parts 25, 30 are commercially available permanent magnets of flat construction, known per se. The stop mechanism of the present invention operates in connection with the two working parts as follows:

In the position shown in FIG. 1, the storage container 40 rests on a base, not shown, such as a table or a workbench, with the cover 3 shown in the open position relative to the box-like part 1, and secured in this position by the supporting lever 7 hinged to the cover and in engagement with the stop mechanism 15. In FIG. 4 the actuation member 18 is shown extending downwardly from the bottom $1_a$ of the box-like part, however, when the box-like part rests on a support base the actuating member is pressed against the biasing force of spring 20 through the weight of the container into the recess 19 in the bottom sleeve, such as is displayed in FIGS. 2 and 3. If the container experiences a small lifting motion and/or a tilting motion in the direction of the arrow A in FIG. 2, the actuating member 18 and the stop pin 10 connected to it and guided within the guide sleeve 11 is pushed outwardly from the bottom $1_a$ of the box-like part 1 by the biasing force of the spring 20 in the direction opposite to the arrow A. As a result, the stop pin moves out of engagement with the roller 8 of the supporting lever 7 and simultaneously the cover 3 is returned toward the closed position by the biasing force of the helical springs 23, 23' on the hinges securing the cover to the box-like part. At this time, the stop mechanism 15 assumes the position illustrated in FIG. 4. Due to the arrangement of the magnetic elements 27, 32 in the locking parts 25, 30 shown in FIGS. 8 and 9, at the end of the closing movement in the direction of arrow 35 in FIG. 9, initially there is a delaying action caused by the same polarity of the segments of the magnetic elements and then an accelerated closing action because of the opposite polarity segments as the cover 3 finally moves into the closed position.

While specific embodiments of the invention have been shown and described in detail to illustrate the application of the inventive principles, it will be understood that the invention may be embodied otherwise without departing from such principles.

I claim:

1. A mechanism for closing a storage container such as a container divided to hold an assortment of parts, the storage container comprising a box-like part having a bottom, side walls and partition walls within said side walls, a cover hinged to said box-like part and displaceable between a closed position and an open position, first spring means for biasing said cover into the closed position, stop means for countering the action of said first spring means and retaining said cover in the open position, said stop means arranged to release said cover and return said cover to the closed position when the storage container is lifted or displaced from a support base, wherein the improvement comprises that said stop means includes an axially extending guide sleeve secured to and extending upwardly in the axial direction from said bottom of said box-like part, a stop pin positioned within and slidably displaceable in the axial direction of said guide sleeve between a first position where said cover is in the open position and a second position where said cover is in the closed position, second spring means for biasing said stop pin into the second position, an elongated supporting lever having a first end and a second end with said first end pivotally connected to said cover, said stop pin in the open position of said cover being engageable with the second end of said support lever when said bottom of said container is resting on a support base so that said cover remains in the open position and when said bottom of said container is displaced from the support base said second spring means biases said stop pin into said guide sleeve and out of engagement with the second end of said support lever.

2. A mechanism, as set forth in claim 1, wherein a first locking part including a bipolar magnetic element located on said box-like part and a second locking part including a bipolar magnetic element located on said cover with said first and second locking parts being disposed in juxtaposed relation in the closed position of the storage container and said first and second locking parts being arranged for effecting initially a delayed and then accelerated closing action as said cover moves into the closed position on said box-like part.

3. A mechanism, as set forth in claim 2, wherein said bipolar magnetic element associated with said first locking part comprises a positive polarity segment and a negative polarity segment and said magnetic element associated with said second locking part comprises a positive polarity segment and a negative polarity segment and said polarity segments are positioned on said first and second locking parts so that initially during the closing action of said cover into the closed positions segments of the same polarity are disposed in juxtaposed position and then during the continued closing action opposite polarity segments are disposed in juxtaposed position with said cover disposed in the closed position on said box-like part.

4. A mechanism, as set forth in claim 1, wherein said guide sleeve is formed integrally with said bottom of said box-like part and extends upwardly along one of said partition walls of said box-like part and said guide sleeve is formed integrally with said partition wall along which it extends.

5. A mechanism, as set forth in claim 1, wherein a roller is rotatably mounted on the second end of said supporting lever and said roller engages said stop pin in the open position of the storage container, an angle-shaped section formed on and extending laterally from said supporting lever so that said angle-shaped section rests on the adjacent said partition wall in said box-like part so that said angle-shaped section guides the movement of said supporting lever between the opened and closed positions.

6. A mechanism, as set forth in claim 1, wherein said stop pin has an upper end and a lower end with said upper end arranged to project upwardly from said guide sleeve in the open position of said cover, a projection extending laterally outwardly from the upper end of said stop pin, a groove formed in the upper end of said guide sleeve and arranged to receive said projection when said cover is in the closed position.

7. A mechanism, as set forth in claim 1, wherein an actuating member is secured to the lower end of said stop pin, said second spring means comprises a spring encircling said stop pin and extending between said actuating member and a downwardly facing surface in said guide sleeve.

8. A mechanism, as set forth in claim 7, wherein said stop pin and said guide sleeve each having a corresponding planar surface disposed in juxtaposition so that stop pin does not rotate as it is axially displaced within said guide sleeve.

* * * * *